US008939593B2

(12) United States Patent
Kothari

(10) Patent No.: US 8,939,593 B2
(45) Date of Patent: Jan. 27, 2015

(54) TEMPORARY AND/OR EMERGENCY LIGHTING SYSTEM WITH INFLATABLE BEARING STRUCTURE

(76) Inventor: Manish Kothari, Jacksonville, FL (US)

( * ) Notice: Subject to any disclaimer, the term of this patent is extended or adjusted under 35 U.S.C. 154(b) by 419 days.

(21) Appl. No.: 13/404,302

(22) Filed: Feb. 24, 2012

(65) Prior Publication Data

US 2012/0287615 A1 Nov. 15, 2012

Related U.S. Application Data

(63) Continuation-in-part of application No. 12/860,230, filed on Aug. 20, 2010, now Pat. No. 8,328,377.

(51) Int. Cl.

| | |
|---|---|
| ***F21V 3/02*** | (2006.01) |
| ***F21L 13/00*** | (2006.01) |
| ***F21V 21/06*** | (2006.01) |
| *F21W 131/10* | (2006.01) |
| *F21V 29/00* | (2006.01) |

(52) U.S. Cl.

CPC ..... *F21L 13/00* (2013.01); *F21W 2131/10* (2013.01); *F21V 3/026* (2013.01); *F21V 21/06* (2013.01); *F21V 29/2293* (2013.01)

USPC ..... 362/96; 362/192

(58) Field of Classification Search

USPC ..... 362/96, 363, 486, 542, 278, 808; 446/220

See application file for complete search history.

(56) References Cited

U.S. PATENT DOCUMENTS

| | | | | |
|---|---|---|---|---|
| 7,204,740 | B2 * | 4/2007 | Petell | 446/220 |
| 8,328,377 | B1 * | 12/2012 | Kothari | 362/96 |
| 2009/0067163 | A1 * | 3/2009 | Au | 362/158 |
| 2009/0141491 | A1 * | 6/2009 | Chu | 362/231 |

* cited by examiner

*Primary Examiner* — Anh Mai
*Assistant Examiner* — Brenitra M Lee
(74) *Attorney, Agent, or Firm* — Lawrence J. Gibney, Jr.

(57) ABSTRACT

In order to provide a temporary lighting solution in extreme weather or lighting conditions, this application has been conceived. A set of blowers will continuously operate to inflate a long cylindrical tube in which a light has been placed to illuminate a designated area. Because the unit may be used outdoors a stabilizing rod has been placed in the event of a sudden loss of power to prevent the tube from deflating rapidly and descending rapidly to the ground level and causing possible injury to persons on the ground or the light itself. Because this device may be used in extremely windy conditions, a plurality of outriggers will attach to the frame and extend outward to stabilize the device, when needed. Because the blowers will operate continuously and thereby produce noise a plurality of noise abatement containers are placed around the blowers to help lessen the noise level.

7 Claims, 10 Drawing Sheets

TEMPORARY AND/OR EMERGENCY LIGHTING SYSTEM WITH INFLATABLE BEARING STRUCTURE

RELATED TO OTHER APPLICATIONS

This is a continuation in part of a application that was filed on Aug. 20, 2010 and assigned Ser. No. 12/860,230 now U.S Pat. No. 8,328,377. The undersigned wishes to take advantage of the filing date for the earlier application.

BACKGROUND OF THE INVENTION

A. Field of the Invention

This relates to portable sources of light, particularly light that needs to be spread over a wide range, but only on a temporary basis. The device can be used in a variety of environments and is expected to be subjected to extremes in conditions.

B. Prior Art

There is one other prior art reference that is closely related to the current application and is found at Medici, U.S. Pat. No. 6,322,230. This current patent application improves on the Medici patent by adding a guiding or stabilizing rod to insure that the light source remains constantly in place and prevents the swaying of the light during windy conditions. Additionally, in the event of a sudden loss of power the stabilizing rod will prevent the sudden collapse of the balloon thereby preventing injury to persons on the ground. The Medici patent uses a plurality of guide wires to stabilize the light source but that in turn requires a great deal of surface area in which to deploy the device. At times this surface area is simply not available.

Additionally the means to deflate the device has been improved as well as an improvement in the circuitry in the present application. None of the improvements were contemplated by the original patent.

BRIEF SUMMARY OF THE INVENTION

This device is used for temporary lighting needs. This may be done in open fields at night, on ships at sea, or at events such as outdoor weddings and banquets. The light will be placed inside a long cylindrical tube that is inflatable. When the device is not used the tube is deflated and the tube is rolled up and stored on the unit.

The structure will be comprised of a base structure that has a top surface and a series of other supporting members. Under the top surface an area will be provided to house a power source that will be used to inflate the tube and activate the light within the tube during normal operation.

In order to make the device as user friendly as possible and to access the power source, which is likely to be a portable generator, a slidable mounting unit is placed on the structure.

On the top surface of the base structure will be mounted a cylindrical tube that houses the light and can be inflated to produce a light source. When the device is not used the tube with the light source can be easily folded and stowed.

On the top surface of the device will be the inflatable lighting structure. In operation, the power source will inflate the light structure.

One of the challenges in the prior art reference was that, because of the length or height of the light structure, the cylindrical tube may be subject to high winds, making the device unstable and impractical to use.

In the prior art reference a plurality of guide wires were contemplated to stabilize the device. This however proves to be impracticable in the field because of the area that is required to secure the wires to the ground surface.

A stabilizing rod that is secured to the top surface of the base structure will attach to a portion of the inflatable light structure or tube. More than one stabilizing rod may be used with this device to provide the needed stability. In the event of a sudden loss of power the stabilizing rod will prevent the light from falling quickly to the ground and potentially causing injuries to person on the ground or damage to the equipment i.e. shattering of the light source.

The device itself is designed to be used primarily outdoors where lighting conditions are sometimes problematic. In an effort to stabilize the frame of the machine, a plurality of outrigger arms are attached to the frame of the device. The stabilizing arms can easily be removed if not needed. The arms can also be rotated so that the user can find the ideal position for each of the arms.

Additionally it may be necessary to either lengthen or shorten the length of the cylindrical light structure. This may become necessary due to the outside conditions that make it difficult to stabilize the light structure or because of height concerns in a given area. A series of zippers around the perimeter of the light structure will provide a means to shorten or lengthen the light structure.

Near the bottom of the inflatable light structure will be a way to deflate the device, specifically an air vent. The air vent may be comprised of a variety of means to deflate the structure but a zipper is likely to be used.

The blower on this device will supply a steady stream of air to inflate the tube that supports the light. Unfortunately, one of the effects of constant blower operation is the production of noise. A noise dampening device will be installed on the bottom of the blower motors. The housing will fit over the blower motor and will be insulated to provide noise reduction. A hole will be placed on the sides of the housing that will permit the air to flow freely through the chamber so that the flow of air is not interrupted and remains unimpeded. The housing can be easily detached if replacement of the blower motor is needed.

There may be a variety of ways to anchor the inflatable light structure by placing one end of the stabilizing rod in a cavity on the top surface, probably a suitable way to anchor the rod. This makes removal and storage of the rod easy when the device is no longer needed.

Below the top surface plate will be the power source, which is more than likely to be a portable generator. One of the difficulties in the prior art reference is gaining access to the power source. In the current application a mounting slide is used to secure the power source. When the power source is to be accessed, the user simply slides the power source out and services the power source. In this application another power source (generator) can be easily installed because of the unique mounting slide so that power to operate the device can be insured without waiting for another power source to be installed.

NUMBERING REFERENCE

Figure 1:
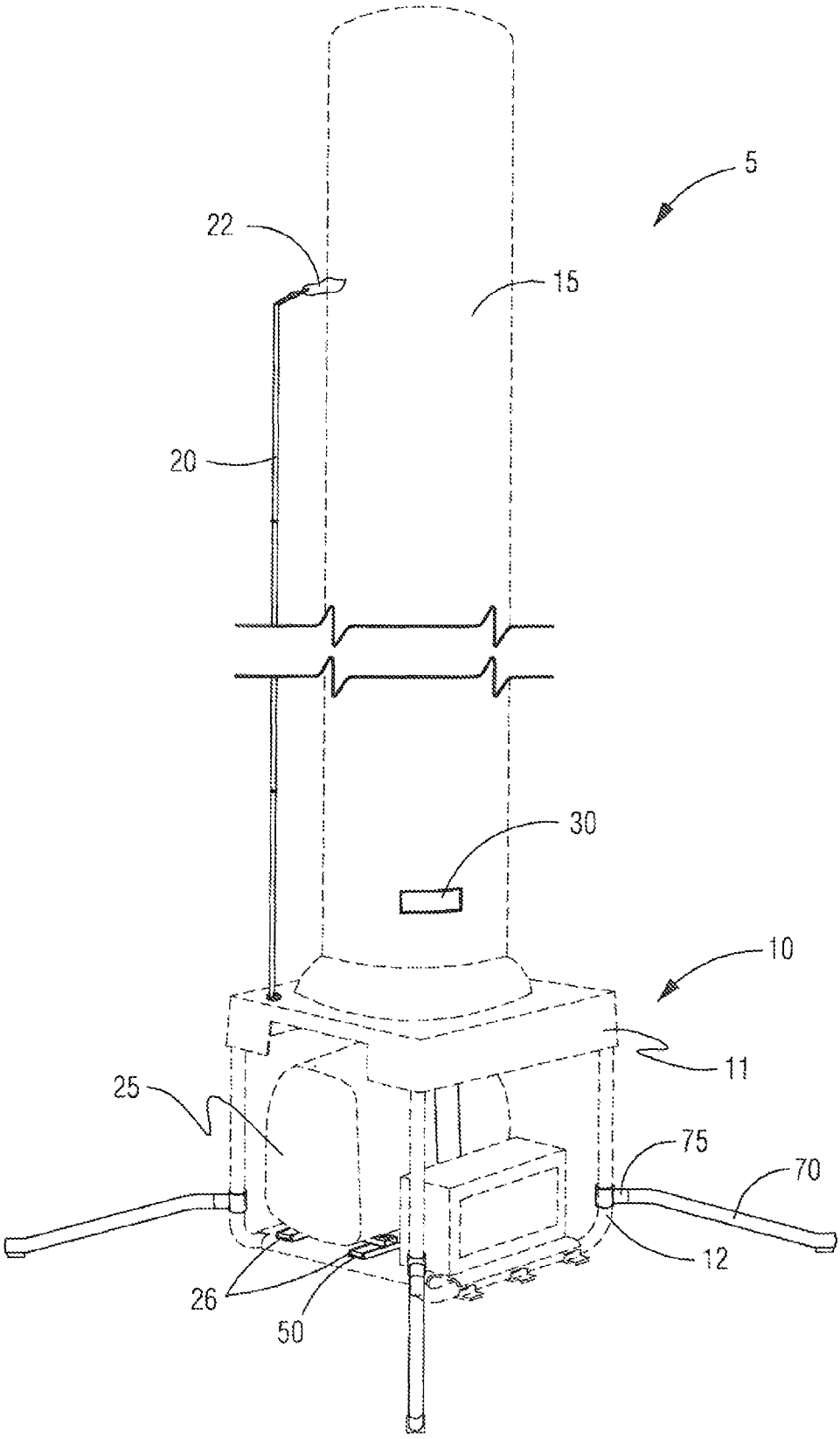
FIG. 1 is an isometric view of the device in the inflated stage.
Figure 2:
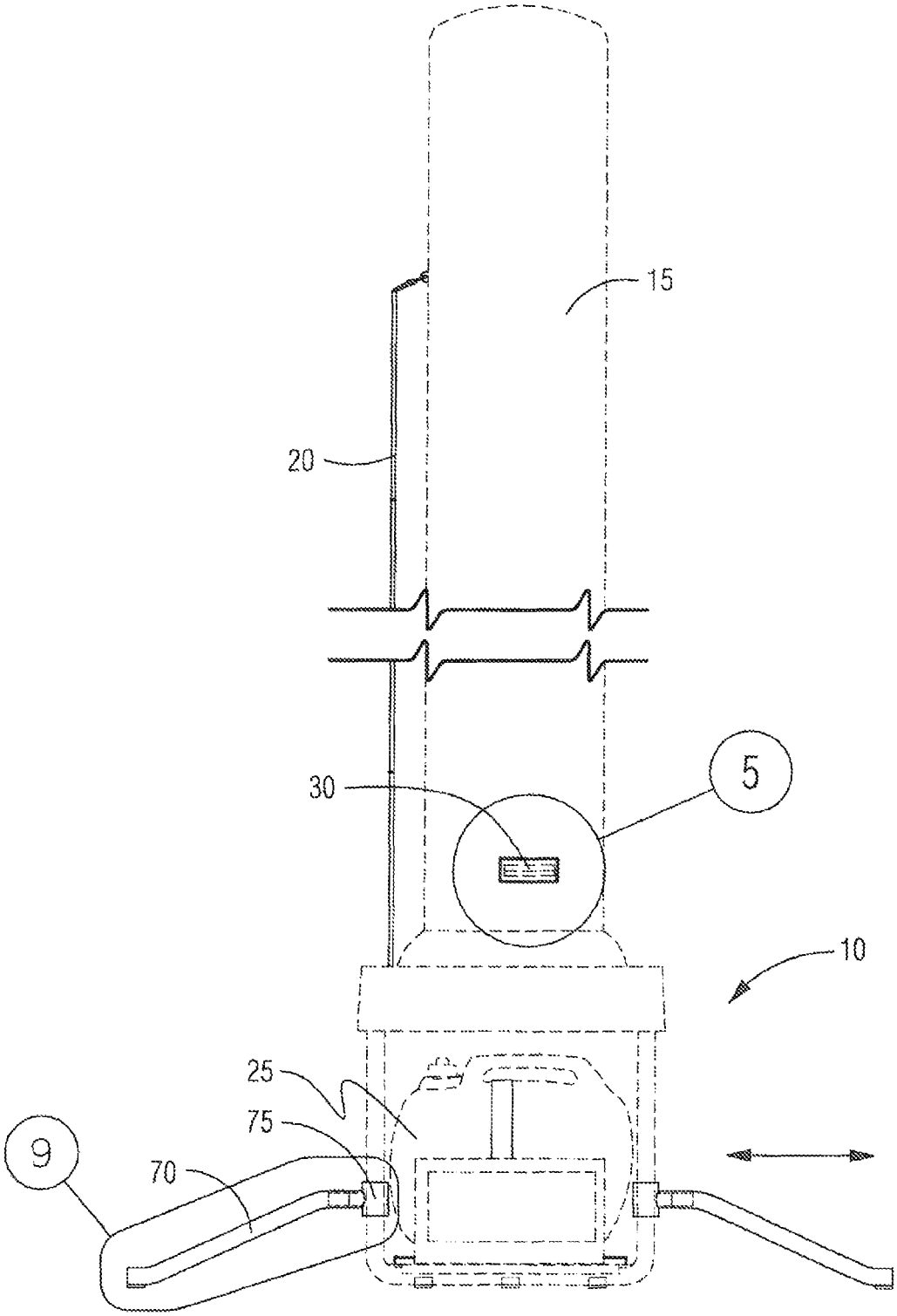
FIG. 2 is a front view of the device depicting an inflated view.
Figure 3:
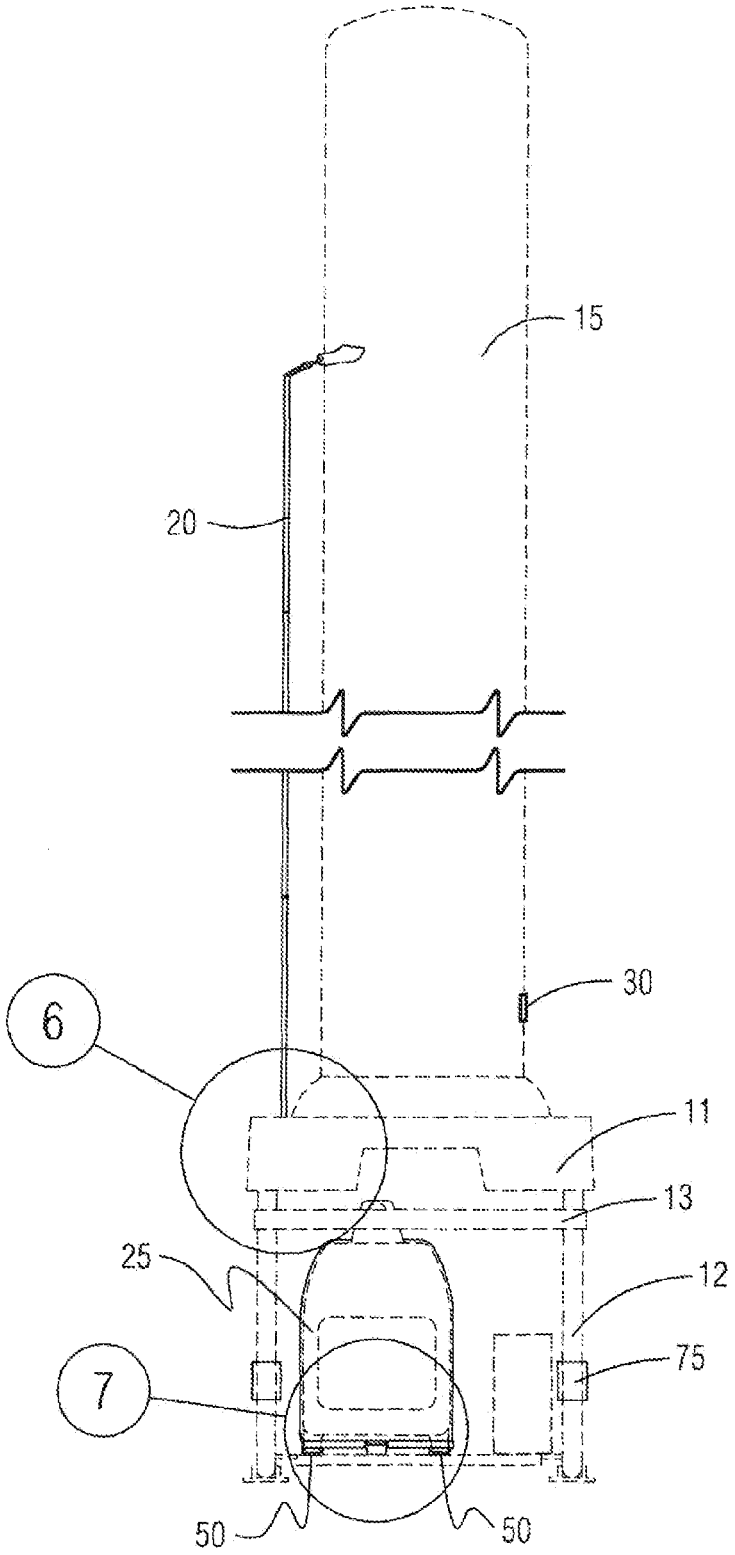
FIG. 3 is a side view of the device, highlighting both the top surface and the generator.
Figure 4:
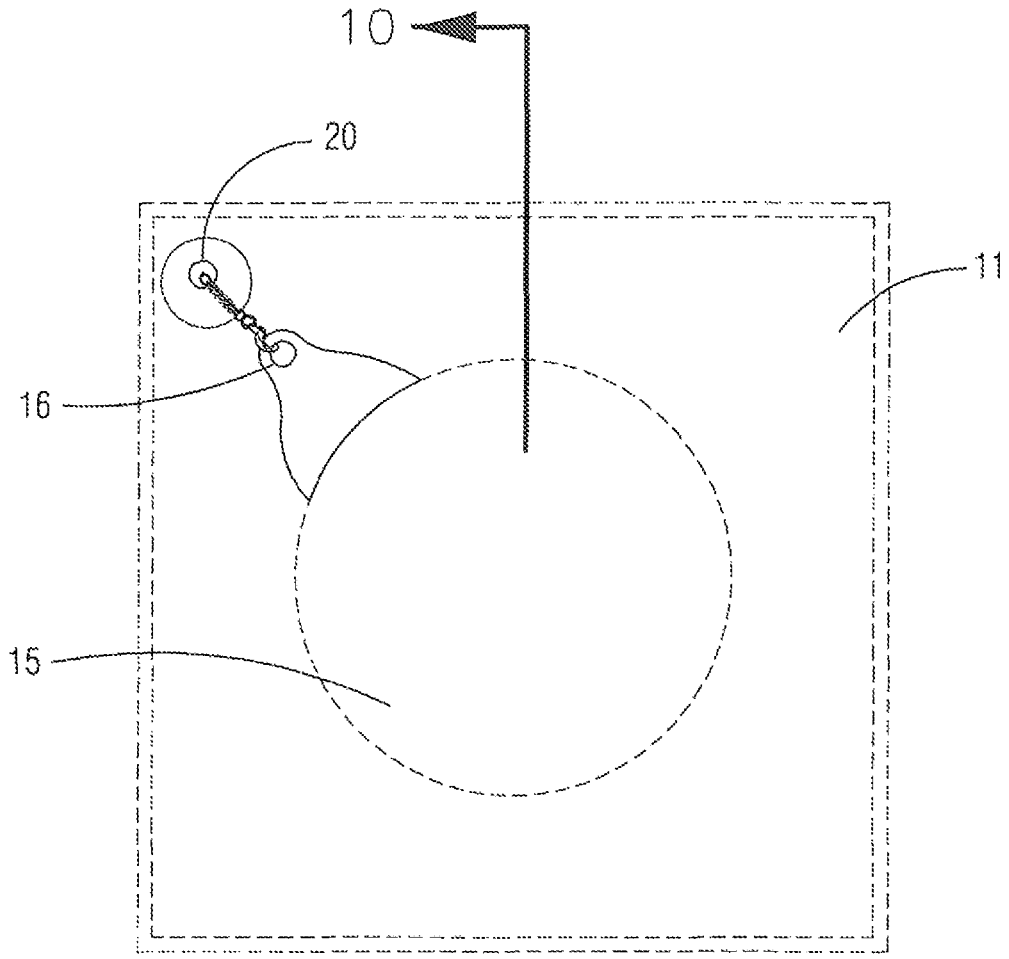
FIG. 4 is a top view of the device.
Figure 5:
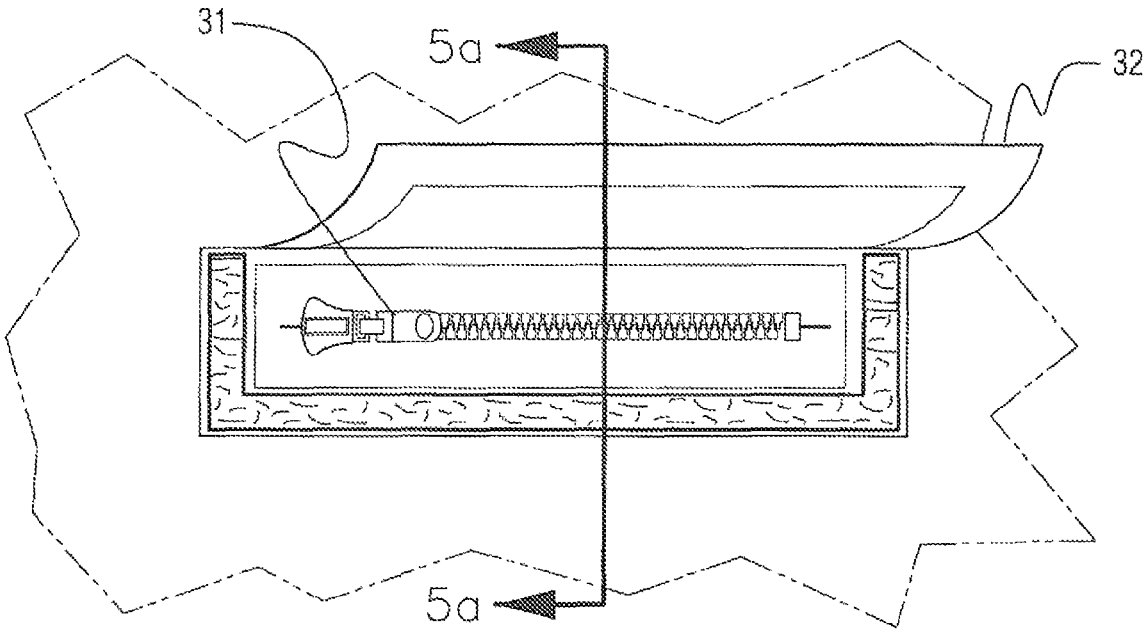
FIG. 5 is a fragmented view of the means to deflate the device.
Figure 5A:
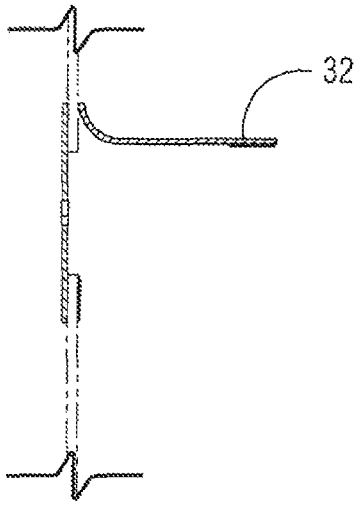
FIG. 5*a* is a cross-sectional view of the means to deflate the device shown in FIG. 5.
Figure 6:
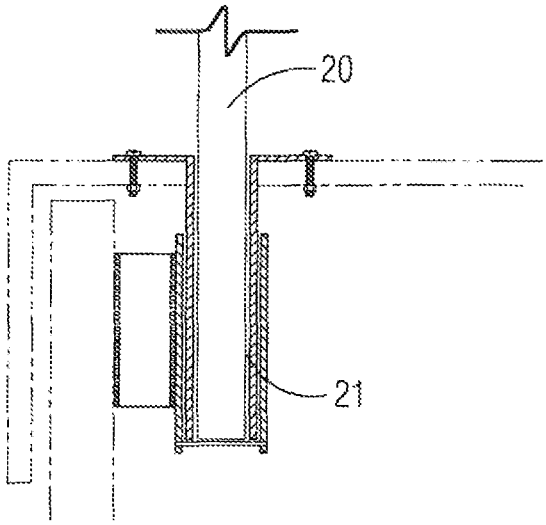
FIG. 6 is a fragmented view of the enclosure to support or anchor the guide rods.
Figure 6A:
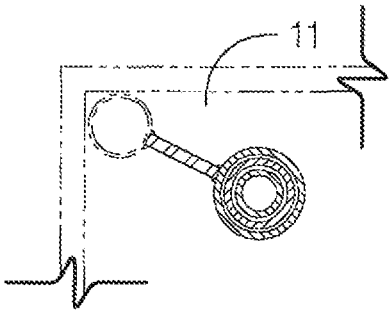
FIG. 6*a* is a fragmented top view of the enclosure to support or anchor the guide rods.

5—Device
10—Base
11—Top surface
12—U-shaped members
13—Crossbar
15—Light
16—Means of attachment
20—Stabilizing rod
21—Cavity
22—Rod Attachment Flap
25—Power source
26—Openings in tray
27—Straps for Power Source
28—Means of attachment for Tray
29—Means to Lock
30—Air vent
31—Closure means
32—Protective flap
50—Tray for Power Source
51—Member to support power source
55—Noise Abatement Canister
60—Insulation in Blower Housing
65—Holes on Blower Housing
70—Outrigger Arm
75—Outrigger Arm Bushing

DETAILED DESCRIPTION OF THE EMBODIMENTS

This device is intended to be a portable light source. This device may be used in extreme conditions either on land or at sea. It is designed to provide sufficient lighting during times of extreme conditions.

The device 5 will be comprised of a base member 10 on top of which is mounted an inflatable light structure 15, which is likely to be opaque in order to provide the necessary amount of lighting for any given condition. The light structure 15 will of a predetermined height or length and likely cylindrical and different lengths may be used.

The light structure 15 is likely to be of a synthetic material, although a variety of other materials may be used. In the light structure 15 will be a light (not depicted) secured to the interior of the tube. The tube should be able to withstand extreme conditions and should be strong enough for those conditions. Although many different materials may be used for the light structure and no specific material is being claimed, the primary considerations for the choice of material are the ability to withstand outdoor weather conditions and provide an adequate lighting area.

In order to stabilize the lighting structure, particularly during windy conditions, a rod attachment flap 22 will be positioned on the side of the light structure 15. This rod attachment flap 22 will be secured to a stabilizing rod 20.

Many different methods may be used to attach the stabilizing rod 20 to the rod attachment flap and no one method is being claimed.

The stabilizing rod will be parallel to the lighting structure 15 and will provide a means to maintain the essentially vertical shape of the light structure during normal use. One end of the stabilizing rod will be placed in a cavity 21 on the top surface 11 of the base 10.

Although in FIG. 1, only one rod attachment flap 22 is depicted, more than one rod attachment flap and stabilizing rod may be used.

Another issue that may occur is the danger of tipping that is caused by extreme winds, particularly because this device is designed is used primarily outdoors. In order to address this issue a plurality of outrigger arms 70 will be attached to the frame of the device, probably through use of a bushing 75. This enables the user to quickly unhook the outrigger arms 70 if not needed. Additionally the outrigger arms 70 may telescope to provide flexibility in terms of stabilizing the device.

When the device is operated, a power source 25 will be used to inflate the cylindrical lighting structure 15. This power source 25 is likely to be a portable generator, although other sources may be used and the means to inflate will be a blower that will force air into the interior of the light structure. The blower will be operated by the power source.

The power source 25 will be placed on a slidable mounting surface 51 that is placed with a solid mounting tray 50 that is attached to the frame structure 12.

The feet of the power source 25 will be placed in a plurality of grooves 26 on the slidable mounting surface for that purpose and straps 27 are used to further secure the power source to the slidable mounting surface 51.

A crossbar 13 is placed across the side of the frame structure so that the power source is prevented from sliding beyond that point.

Figure 8:
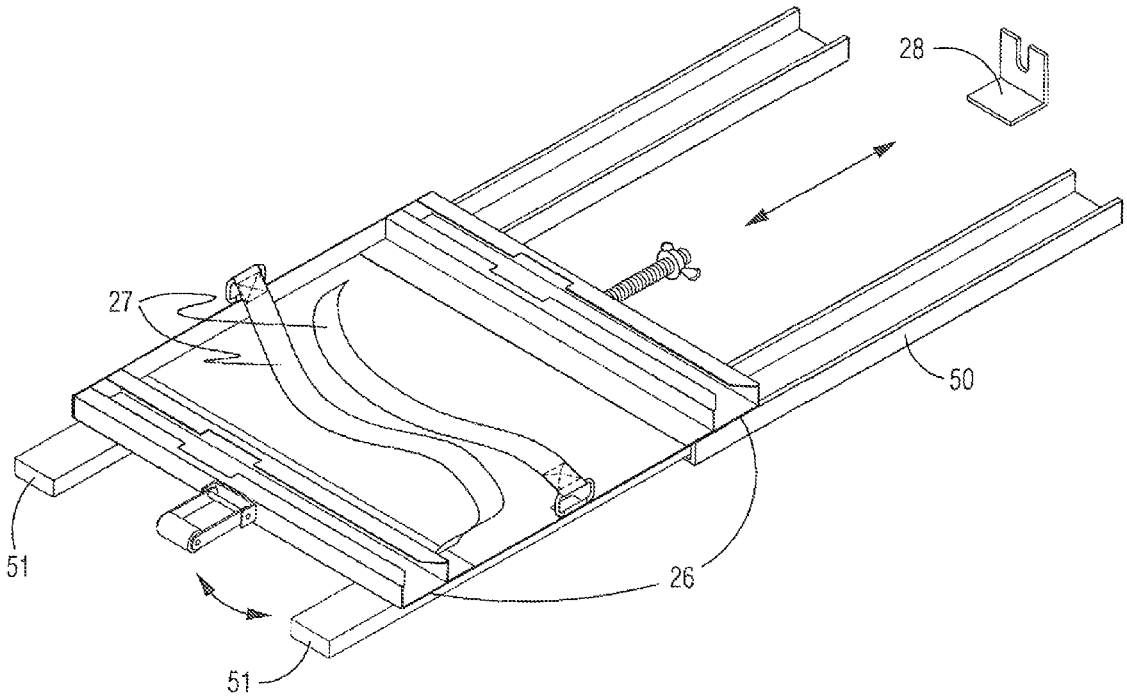
FIG. 8 is a depiction of the device as it is being used as a means to change the power source.
Figure 9B:
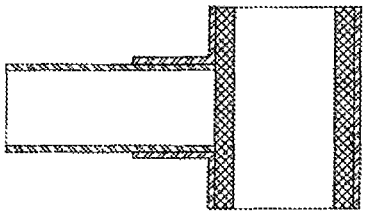
FIG. 9B is a cross-sectional view of the bushing on the outrigger arm.
Figure 9A:
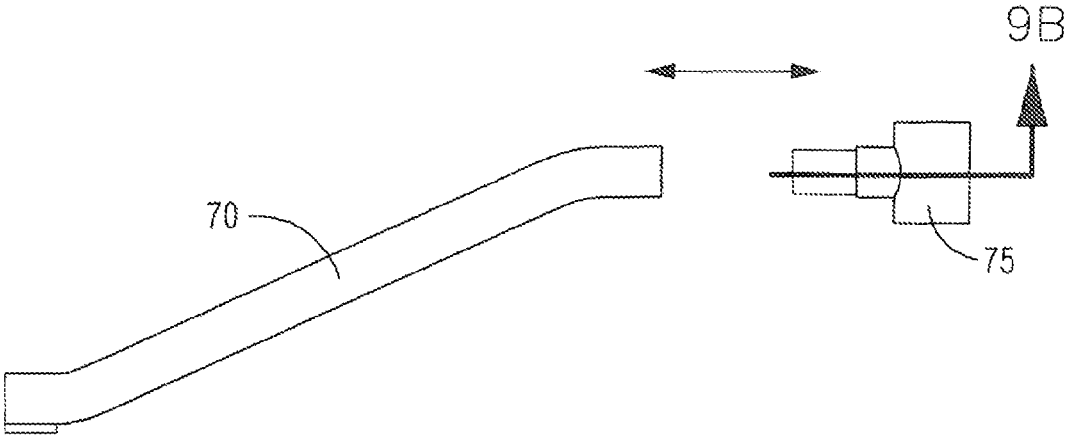
FIG. 9A is a side view of the outrigger depicting being removed from the bushing.
Figure 9:
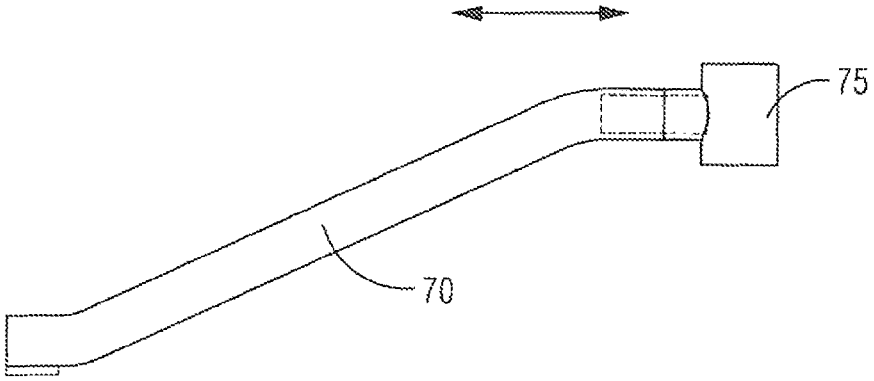
FIG. 9 is a side view of the outrigger arm and the bushing.
Figure 10:
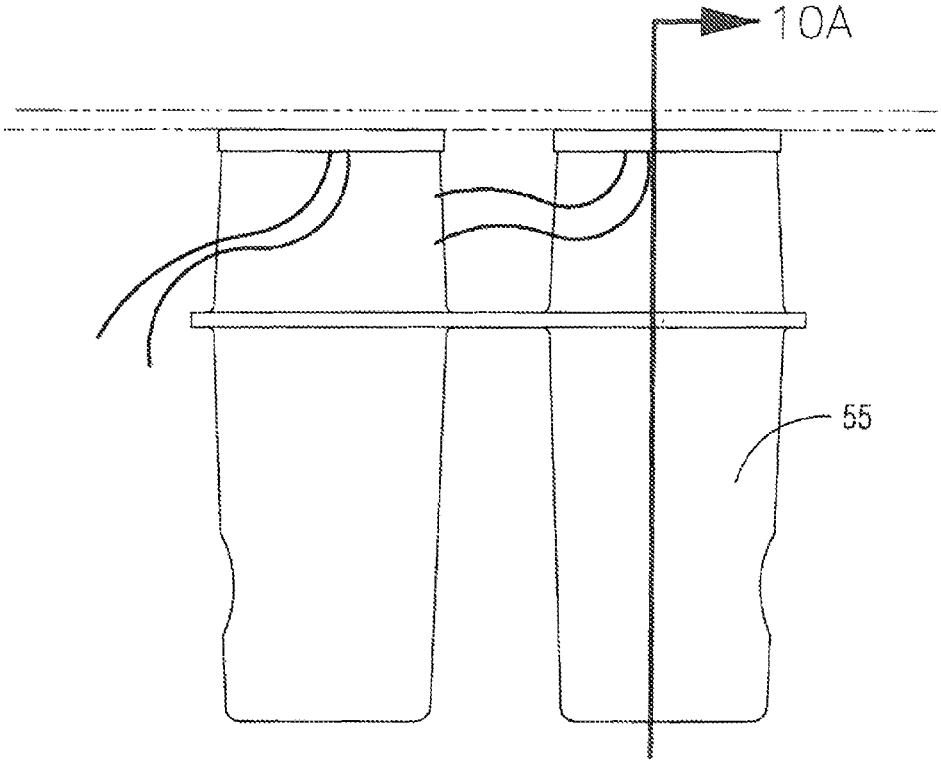
FIG. 10 is front view of the noise abatement canister.
Figure 10A:
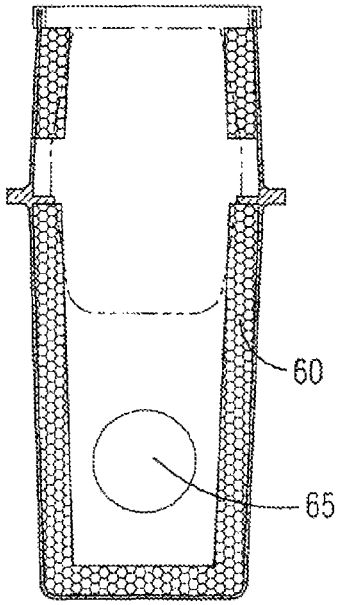
FIG. 10A is a view according to line 10A on FIG. 10.

The sliding mount surface 51 will move such as depicted in FIG. 8 so that the power source can easily be serviced by removing the crossbar 13 and sliding the power source out for service.

Figure 7A:
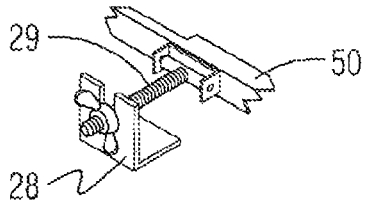
FIG. 7*a* is an isometric view of the tray locking device.
Figure 7:
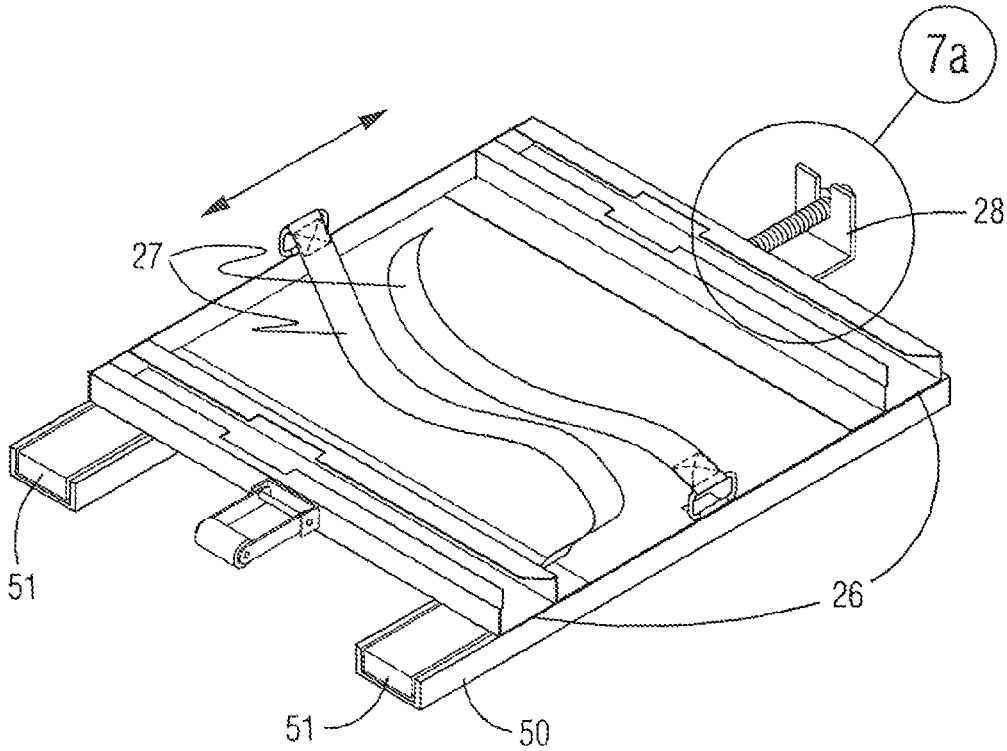
FIG. 7 is an isometric view of the structure that will be used to change the power source.

In order to insure that the power source remains in one position, a means to lock 29 the power source to the sliding mount 51 is provided. A means of attachment 28 that is secured to the frame allows the means to lock 29 to be secured as an additional means to prevent the power source from being moved. A number of means to lock the power source may be used and a wing nut is depicted in FIG. 7*a* but other means are contemplated.

When the device is operated, the cylindrical tube sliding structure 15 will be inflated to a predetermined height. The light that is placed in the interior of the light structure is likely to produce a great deal of heat. Consequently, a means to operate the blower separately from the light is provided. This will allow the operator to extinguish the light prior to deflation in order to dissipate some of the heat from the light and prevent human injury during the deflation process as well as prevent injury to the device.

The electrical circuitry that operates the blower and the light will be constructed so that these elements will operate separately from each other; the wiring is specifically so that light will not operate until the blower is operational to prevent a build up of heat by the light. Because of the intense heat that is generated by the lamp inside the lighting structure a cool down period is recommended. The circuitry is configured so that the lamp can be turned off independent of the blower. Prior to the device being deflated the lamp can be turned off to allow the structure to cool down.

Because there is a constant flow of air through constant blower operation, an excessive level of noise may occur to the point where conversation may become difficult. Two blower motors are used in the operation of this device and are positioned to force air directly into the lighting device. In an effort to reduce the level of noise a blower housing 55 is attached to the underside of the top structure and surrounds the blower intake. The noise abatement canister is insulated 60 to provide noise abatement. The length of the blower housing is approximately eight inches. Holes 65 on the side of each one of the noise abatement canister are also provided to insure an uninterrupted flow of air through the housing. If the holes 65 are placed on the bottom of the blower housing 55, noise abatement will not occur.

Once the appropriate cooling period has occurred, the cylindrical lighting structure 15 can be deflated. A means to deflate 30 will be used and is likely to be an air vent 30 at the bottom of the light structure 15. A variety of air vents may be used and a zipper over a portion of the material for the light structure is one means to provide an air vent 30.

In order to protect the air vent from damage as well as inadvertent opening, a protective flap 32 is likely to be placed over the vent. A means to open the air vent is also used and one choice would be a zipper.

In some situations it may be practical to either shorten or lengthen the light structure. This may be accomplished through a series of zippers (not depicted) around the perimeter of the light structure that can secure a portion of a section of the light structure to either shorten or lengthen the vertical dimensions of the light structure.

While the embodiments of the invention have been disclosed, certain modifications may be made by those skilled in the art to modify the invention without departing from the spirit of the invention.

The inventor claims:

1. A temporary portable lighting structure that is comprised of:

a. a light structure;

wherein the light structure is of a predetermined length;

wherein the light structure has a predetermined shape;

wherein a light is secured to the interior of the lighting structure;

wherein the light structure is mounted to a base;

wherein the light structure can be inflated;

b. means to inflate;

wherein a means to inflate the light structure is provided;

c. a base;

wherein said base supports the light structure;

wherein the base has a top surface of predetermined dimensions;

wherein the base is supported by base members;

wherein the base is hollow;

wherein said base supports the power source;

d. a stabilizing rod;

wherein a stabilizing rod is used;

wherein the stabilizing rod is positioned on a top surface of the base;

e. a cavity for the stabilizing rod;

wherein the cavity is placed on the top surface of the base;

wherein a portion of the stabilizing rod is placed in the cavity;

f. a rod attachment flap;

wherein the rod attachment flap is placed on the lighting structure;

wherein the stabilizing rod is secured to the rod attachment flap;

g. slidable mounting surface;

wherein a slidable mounting surface is secured to a tray for the power source;

said slidable mounting surface secures the power source;

said slidable mounting surface can be locked in place;

wherein the tray for the power source is secured to a plurality of frame members;

wherein a means to lock the slidable mounting surface is provided;

h. a means to deflate the light structure;

wherein the means to deflate the light structure is placed on the light structure;

wherein a protective flap is provided over the means to deflate;

i. a power source;

said power source operates the means to inflate the light structure;

said power source operates the light;

wherein the means to inflate and the means to illuminate operate independently of each other;

j. means to alter the length of the light structure is provided;

wherein a plurality of zippers around the perimeter of portions of the light structure are provided.

2. The device as described in claim 1 wherein the means to deflate the light structure is a zipper of predetermined shape.

3. The device as described in claim 1 wherein a protective flap is provided over the means to deflate.

4. The device as described in claim 1 wherein a plurality of stabilizing rods are used.

5. The device as described in claim 1 wherein a plurality of rod attachment flaps are used.

6. The device as described in claim 1 wherein a plurality of cavities for the stabilizing rod are used.

7. The device as described in claim 1 wherein the means to lock the slidable mounting surface is a wing nut.

* * * * *